US006464754B1

(12) United States Patent
Ford

(10) Patent No.: US 6,464,754 B1
(45) Date of Patent: Oct. 15, 2002

(54) SELF-CLEANING AIR PURIFICATION SYSTEM AND PROCESS

(75) Inventor: Joe Ford, Cary, IL (US)

(73) Assignee: Kairos, L.L.C., Cary, IL (US)

( * ) Notice: Subject to any disclaimer, the term of this patent is extended or adjusted under 35 U.S.C. 154(b) by 0 days.

(21) Appl. No.: 09/516,265

(22) Filed: Feb. 29, 2000

Related U.S. Application Data

(63) Continuation-in-part of application No. 09/414,416, filed on Oct. 7, 1999, now abandoned.

(51) Int. Cl.[7] ..... B03C 3/68

(52) U.S. Cl. ..... 95/26; 55/385.1; 95/73; 95/76; 95/78; 96/25; 96/26; 96/31; 96/51; 96/63; 96/74; 96/97; 361/226

(58) Field of Search ..... 96/63, 73, 74, 96/97, 18, 30, 51, 31, 25, 26; 95/73, 78, 79, 2, 68, 76, 26; 55/385.1, 385.2; 119/420, 493, 500, 447, 448; 361/226, 231

(56) References Cited

U.S. PATENT DOCUMENTS

| | | | | | |
|---|---|---|---|---|---|
| 470,608 | A | * | 3/1892 | Wardhaugh | 96/51 |
| 2,604,184 | A | * | 7/1952 | Warburton et al. | 96/31 X |
| 2,758,666 | A | * | 8/1956 | Prentiss | 96/73 X |
| 2,931,880 | A | | 4/1960 | Yaffe | 261/DIG. 89 |
| 2,942,090 | A | | 6/1960 | Diehl | 392/392 |
| 3,522,935 | A | | 8/1970 | Lewis | 261/30 |
| 3,687,834 | A | * | 8/1972 | Candor | 95/78 X |
| 4,227,894 | A | | 10/1980 | Proynoff | 361/231 X |
| 4,376,642 | A | | 3/1983 | Verity | 55/467 X |
| 4,380,720 | A | | 4/1983 | Fleck | 315/111.91 |
| 4,643,745 | A | | 2/1987 | Sakakibara et al. | 96/76 |
| 4,713,724 | A | | 12/1987 | Voelkel | 361/231 |
| 4,726,814 | A | * | 2/1988 | Weitman | 96/51 X |
| 4,811,159 | A | | 3/1989 | Foster, Jr. | 361/231 |
| 5,010,777 | A | * | 4/1991 | Yehl et al. | 55/385.2 X |
| 5,055,963 | A | | 10/1991 | Partridge | 361/231 |
| 5,064,457 | A | * | 11/1991 | Weber | 55/385.2 |
| 5,099,751 | A | * | 3/1992 | Newman et al. | 55/385.2 X |
| 5,141,529 | A | * | 8/1992 | Oakley et al. | 55/385.2 X |
| 5,153,811 | A | | 10/1992 | Rodrigo et al. | 361/231 |
| RE34,346 | E | | 8/1993 | Foster, Jr. et al. | 361/231 |
| 5,296,018 | A | * | 3/1994 | Suzuki | 55/385.2 X |
| D357,311 | S | | 4/1995 | Yehl | D23/364 |
| 5,535,089 | A | | 7/1996 | Ford et al. | 361/231 |
| D373,416 | S | | 9/1996 | Ford et al. | D23/364 |
| D374,713 | S | | 10/1996 | Ford et al. | D23/364 |
| 6,126,722 | A | * | 10/2000 | Mitchell et al. | 96/97 X |

FOREIGN PATENT DOCUMENTS

| | | | | |
|---|---|---|---|---|
| AU | A-61090/90 | | 2/1991 | |
| EP | 0558090 | A2 | 9/1993 | |
| GB | 2117676 | | 10/1983 | |
| SU | 963565 | * | 10/1982 | 96/97 |
| WO | WO-96/11745 | | 4/1996 | |

* cited by examiner

*Primary Examiner*—Richard L. Chiesa
(74) *Attorney, Agent, or Firm*—Welsh & Katz, Ltd.; Thomas W. Tolpin

(57) ABSTRACT

An economical air purification system and process that greatly reduces concentrations of dust and noxious gases to provide for a cleaner and healthier enviroment for people, plants, poultry and other animals. Desirably, the special air purification system and process has a set of modules arranged for emitting overlapping flow patterns of ions. The modules can include parallel arrays of ionizers which are preferably arranged in a matrix or grid pattern. For even better results, the ionizers can comprise self-cleaning ionizers. One or more fans can be spaced from the modules to circulate the ions and air as well as draw influent air through the intake ports and exhaust purified air through the outlet ports. Heaters can also be provided to heat the circulating air.

19 Claims, 5 Drawing Sheets

SELF-CLEANING AIR PURIFICATION SYSTEM AND PROCESS

RELATED APPLICATION

This application is a continuation-in-part of U.S. application Ser. No. 09/414,416, filed Oct. 7, 1999, of Joe Ford for an Air Purification System and Process, now abandoned.

BACKGROUND OF THE INVENTION

This invention pertains to air purification and, more particularly, to an ionizer system and process to remove dust and noxious gases.

Over the years, many types of air purifiers and equipment have been provided to purify and dedust air. Ionizers are particularly helpful. An ionizer is a device which emits electrically charged ions which clean impurities from the air and provide a feeling of well being to the user. Where possible, the ionizer should accomplish its purpose without creating an amount of ozone which is harmful to people, plants, poultry and other animals.

Some conventional ionizers have sharp needles or pointed wires which emit electrons (ions) produced by high voltage pulses to ionize the air. The sharp needles and pointed wires can puncture and severely cut poultry and other animals, as well as workers and others who many contact such conventional ionizers.

Most conventional ionizers are or should be cleaned on a regular basis to remove accumulation, build up, caking and covering of ionizer needles and/or filters with ionized particles of dust or other debris. Such accumulation has a tendency to hamper the operation of the ionizer, decrease the ionizer's effectiveness and efficiency, and can clog the ionizer. The situation is particularly aggravated and grievous for industrial uses of ionizers, such as for poultry houses and hog confinements. Conventional cleaning of ionizers is tedious, time-consuming, messy and labor intensive. It can also interfere with the operation of the ionizer since the ionizer may need to be shut off during cleaning.

Workers and livestock, such as poultry and pigs, must endure biohazardous conditions on a daily basis. In poultry (fowl) houses and hog confinements (swine houses), for example, chickens, turkeys, ducks, ostriches, and pigs, secrete waste matter which produce noxious gases comprising volatile fumes of ammonia and methane. Poultry also produce great amounts of dust with their feathers. Swine (pigs and hogs) which like to wallow in mud, also produce great amounts of dust when they shake off mud. The biohazardous conditions in the poultry houses create an unsafe atmosphere and unpleasant environment for the birds, swine, livestock, and hog confinements, farmers and workers.

Some poultry houses and hog confinements have an air intake and exhaust system to extract gas and dust into the outside atmosphere. The exhaust fans typically have sensors that trigger the fans on and off depending upon the level of ammonia and dust in the poultry house or hog confinements. Even with conventional exhaust fans running at 100% capacity, the farmers and workers often wear protective masks in poultry houses and hog confinements to attempt to shield the gases and dust from their lungs.

The emission and concentration of noxious gases and dust in conventional poultry houses adversely affect the health, growth rate, and well-being of chickens, turkeys, and other poultry. Excessive amounts of noxious gases and dust can cause poultry to develop eye diseases. It can also cause the poultry to become sick and lose their appetite. As a result, many of the chickens, turkeys and other poultry stop eating and drinking, their growth rate becomes stunted, and their flesh may no longer be tender, firm, and tasty. Unsafe levels of these harmful gases and dust can also kill many of the chickens, turkeys and other poultry.

In order to keep the poultry houses warm, poultry houses are often equipped with heaters, such as butane heaters. During the first three weeks of growth for a new batch of chickens, the poultry house is typically kept at a temperature of: 88° F. for the first week, 85° F. for the second week, and 80° F. for the third week. For the remainder of the seven week growing cycle, the poultry houses are kept at a comfortable level. With the exhaust fans running at a 100% capacity in an attempt to remove some of the noxious gases and dust, the heaters often continuously operate in conventional poultry houses to heat the house to the proper temperature. Continuous operation of the fans and heaters in conventional poultry houses consumes an enormous amount of energy and is very expensive. These expenses are usually ultimately passed on to the consumer.

Many farmers seek improved ways to clean the environment in and around poultry houses. The U.S. Environmental Protection Agency and state environmental agencies are considering implementing higher standards for the quality of air exiting the poultry houses, hog confinements and other biohazardous areas.

It is, therefore, desirable to provide an improved air purification system and process which overcomes most, if not all, of the preceding problems.

SUMMARY OF THE INVENTION

An improved air purification system and process are provided which decrease the concentration of dust and noxious gases to safer levels in poultry houses, swine houses (hog confinements), paper mills, industrial facilities, factories, and dwellings. Advantageously, the efficient air purification system and process help purify the air to provide a healthier and more comfortable environment for people, plants, poultry, swine and other animals. The convenient air purification system and process are also economical, easy to use, simple to install, durable, and effective. Desirably, the user friendly air purification system and process: decrease energy consumption, improves the health and growth rate of poultry and swine, and enhances the safety and well being of farmers, workers and livestock. As a result, the novel air purification system and process provide for: cleaner air for workers and livestock, less pollution, a decrease of energy and power to exhaust the air, reduction in butane and other sources of energy to heat poultry houses, swine houses (hog confinements), and cleaner air emissions.

In the special air purification system and process, overlapping flow patterns of ions are emitted in a room with a set of modules so that the ions can ionize airborne dust and/or noxious gases in the room. Preferably, the air and ions in the room are circulated with a fan system which is spaced from the modules. For poultry houses, swine houses (hog confinements), and other facilities, the air in the room can be heated with at least one heater which is spaced from the fan. Influent air can be drawn into the room and purified effluent air can be discharged out of the room. In the preferred form, the modules are maintained in a spaced apart relationship. Preferably, the modules comprise ionizers and each of the ionizers have an array of ion-emitting needles. The ionizers can have a needle guard which prevents the sharp needles and points of the ion emitters from cutting, puncturing, or otherwise harming poultry, swine, and other animals, as well as from injuring farmers and workers who may contact the ionizers in the poultry houses, swine houses (hog confinements), or other facilities.

In the preferred form, the modules comprise self-cleaning ionizers. Each of the self-cleaning ionizers have an ion-emitting assembly comprising ion-emitters for emitting negatively charged ions to ionize airborne particulates of dust and noxious gases in an area such as a poultry house, swine house, grain elevator, cylo, industrial facility, office, room, residential dwelling, etc. The ion emitters comprise a set series or array of ion-emitting needles with pointed tips that emit the negatively charged ions. The ion-emitting assembly can include a circuit board secured to and supporting the ion-emitting needles. An electric circuit is mounted on the circuit board to cyclically apply a negative potential charge to the ion-emitting needles at a sufficiently high voltage to ionize the particulates of dust and noxious gases without substantially generating ozone. Electrical wires are connected to the electrical circuit and extend from the circuit board to connect the self-cleaning ionizer to an electrical box mounted on the ceiling or wall.

The self-cleaning ionizer also includes a housing assembly for at least partially enclosing and supporting the ion-emitting assembly. The housing assembly has a cover which defines ion-emitting apertures about the ion-emitting needles. A skirt can extend from the cover and can peripherally surround the ion-emitting assembly. A peripheral flange can extend annularly from and about the skirt and can have holes to receive fasteners to secure the housing assembly to a surface of a ceiling, wall, and/or electrical box.

Advantageously, the self-cleaning ionizer features an ion-emitting needle cleaner which is operatively connected to the ion-emitting assembly to remove accumulation, build up, and any caking of particulates of dust and noxious gases from the tips of the ion-emitting needles. Preferably, the ion-emitting cleaner comprises an ion-emitting needle cleaning mechanism which periodically removes particulates of dust and noxious gases from the tips of the ion-emitting needles. A motor can be connected to the electric circuit to drive and automatically activate the ion-emitting needle cleaning mechanism. Preferably, the electric circuit includes tiny circuitry to intermittently activate the ion-emitting needle cleaning mechanism in order to intermittently clean the tips of the ion-emitting needles.

The ion-emitting needle cleaner can comprise a wiper arm assembly. Preferably, the wiper arm assembly comprises at least one motor-driven rotatable radial arm and, most preferably, diametrically opposed integrally connected radial arms. In the preferred form, bristles extend from the rotatable arm to brush and wipe the tips of the needles. The bristles can comprise a brush, natural or artificial hairs, flexible strips, or plastic fingers.

A curved needle guard can extend integrally from the mounting plate. The curved needle guard can comprise curved ribs, such as arcuate or semi-circular ribs, spaced about the ion-emitting needles to substantially prevent the ion-emitting needles from puncturing a human finger, poultry, or animals.

A protective cover and a guard can be provided for covering the wiper arm assembly and the ion-emitting needles to substantially further prevent humans, poultry, and animals from touching the ion-emitting needle cleaner and the ion-emitting needles. The protective cover can comprise a perforated plastic cover comprising a screen with ion-emitting apertures which permits egress and discharge of the negatively charged ions from the tips of the ion-emitting needles out of the self-cleaning ionizer.

A more detailed explanation of the invention is provided in the following description and claims taken in conjunction with the accompanying drawings.

DETAILED DESCRIPTION OF THE PREFERRED EMBODIMENT

An environmentally attractive self-cleaning air purification system and process 10 (FIGS. 1 and 2) are provided which are useful in industrial facilities, homes, and other dwellings. The air purification system and process are particularly useful in poultry houses and swine houses (hog confinements), which house and grow poultry (fowl), such as chickens, turkeys, ducks, ostriches, or swine, such as pigs and hogs. A poultry house can accommodate numerous poultry, such as 18,000 to 30,000 chickens. The poultry and swine secrete waste matter which produce noxious gases comprising volatile fumes of ammonia ($NH_3$) and methane ($CH_4$) gases. The poultry also produce enormous amounts of particulates of dust with their feathers. Swine like to wallow in the mud and produce voluminous amount of dust when they shake off the mud.

Figure 1:
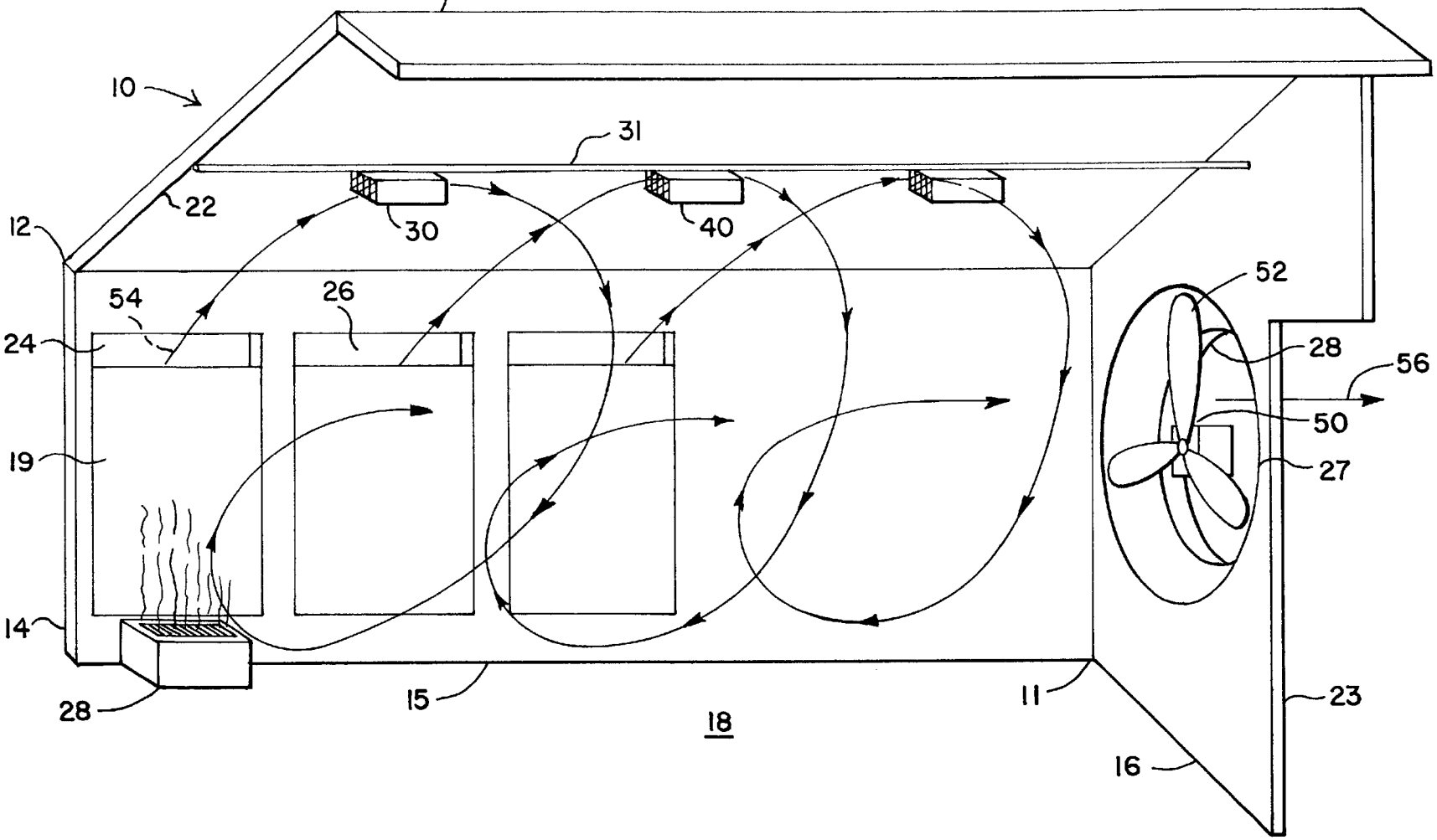
FIG. 1 is a fragmentary perspective view of a self-cleaning air purification system and process in accordance with principles of the present invention.
Figure 2:
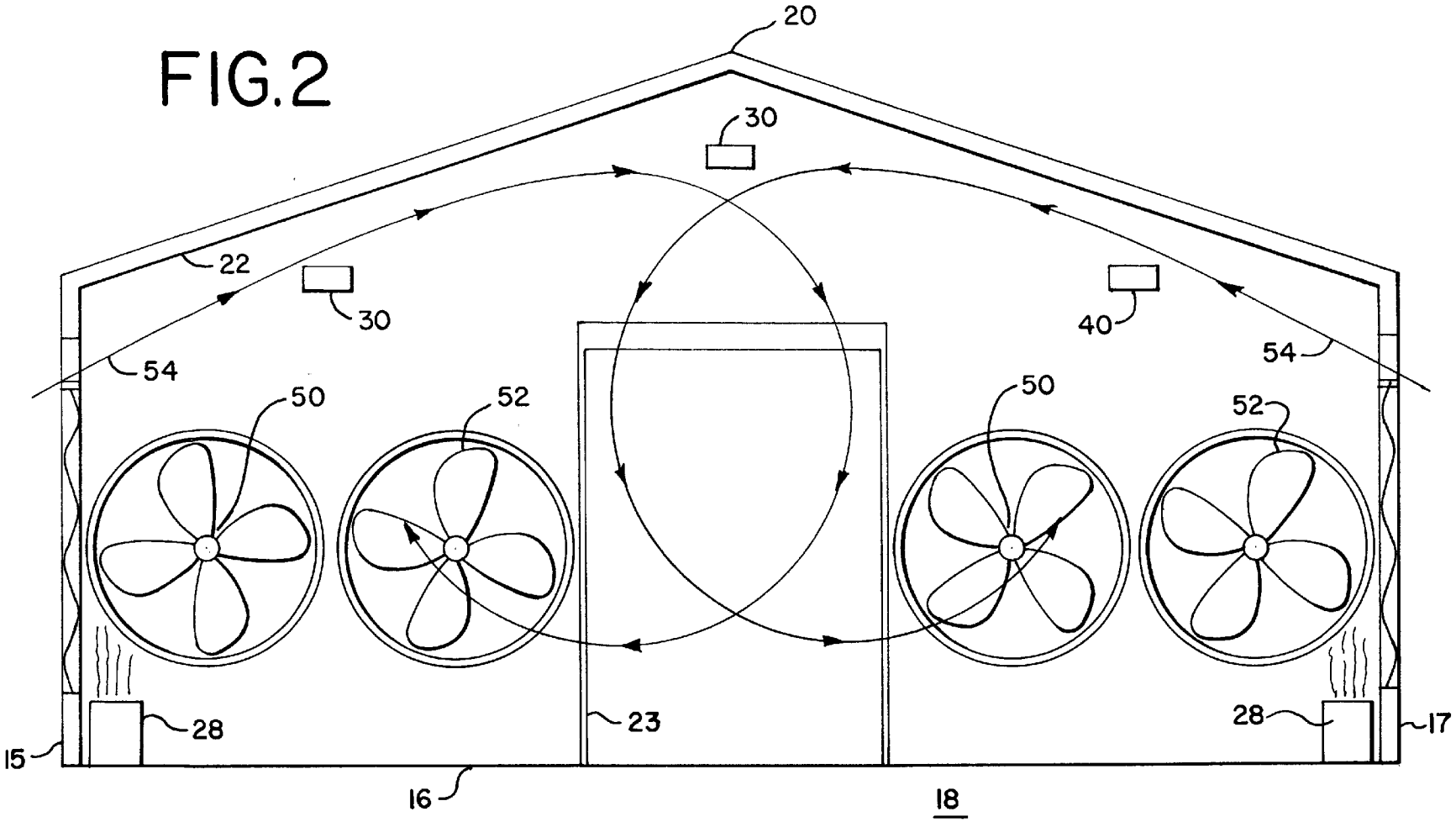
FIG. 2 is a fragmentary front view of the self-cleaning air purification system and process.

FIGS. 1 and 2 illustrate a room 11 of a poultry house 12 having upright walls 14–17, a floor 18, windows 19, a roof 20 with a ceiling 22, and a door or access opening (passageway) 23. An aliquot uniform series, set and array of air inlet passageways 24, which define air inlet ports or air intake ports 26, are provided in at least one of the walls or ceiling, for ingress of influent air into the room. An aliquot uniform series, set, and array of air outlet passageways 27, which define air outlet ports 28, are provided in at least one of walls for egress and exiting of purified effluent air from the room. The outlet ports are substantially larger than the inlet ports and are spaced apart at an elevation below the inlet ports. Heaters 28, such as butane heaters, can be provided to heat the air in the room to warm the poultry. The heaters can be mounted on the floor, walls or ceiling. Preferably, the heaters are suspended from the ceiling or lowered to an operating height, such as 30 inches above the floor.

Figure 3:
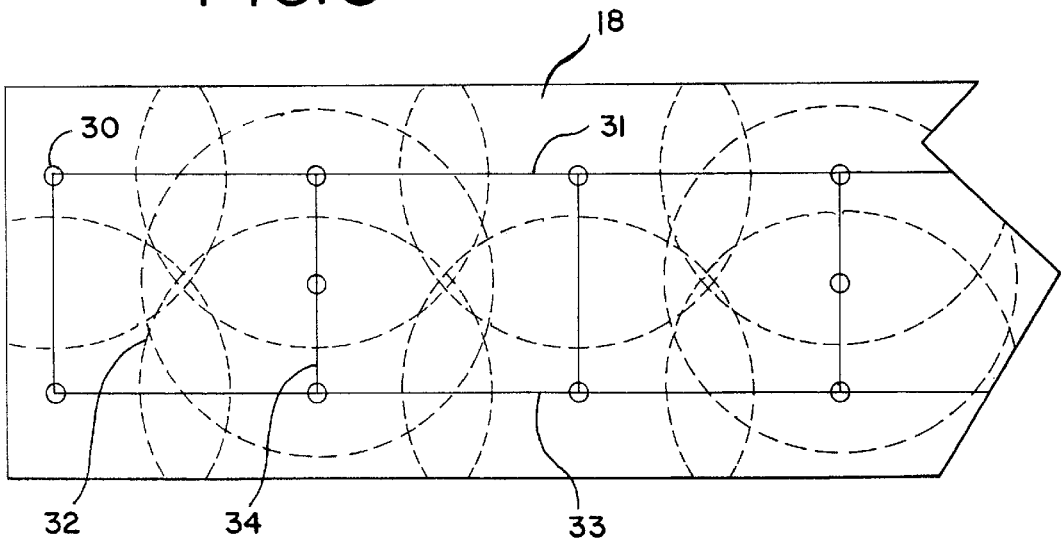
FIG. 3 is a fragmentary reduced top plan diagrammatic view of the modules of the self-cleaning air purification system and process.

An array, set, series, and multitude of interconnected modules 30 (FIGS. 1–3) are positioned at an elevation above the air inlet passageways in proximity to the ceiling. The modules can be directly fastened to the ceiling or can be directly fastened to beams 31, joists, or other members which are secured to the ceiling. The modules cooperate with each other to emit overlapping flow patterns 32 of ions as shown in FIG. 3 to charge particulates of dust and noxious gases in the air of the room. Preferably, the modules are rows, such as shown in FIG. 3, or can provide a matrix or crisscross grid 34, as viewed from the ceiling to saturate the room with ions.

Figure 4:
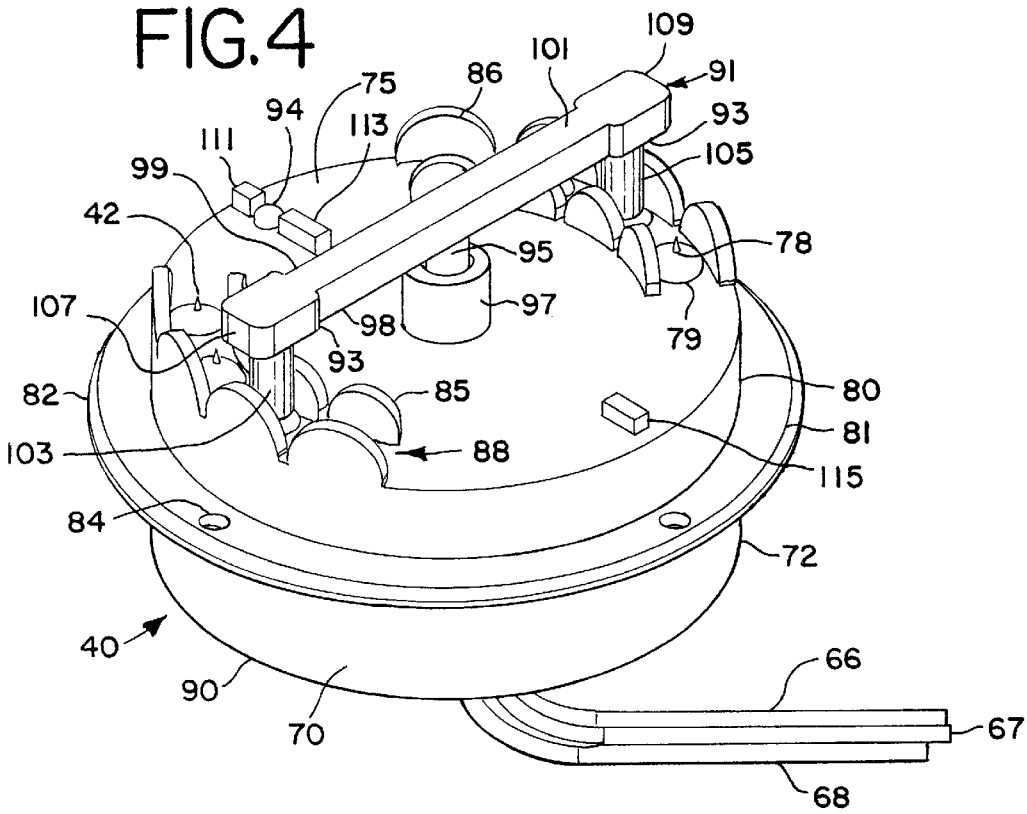
FIG. 4 is an enlarged perspective view of an ionizer for use in the self-cleaning air purification system and process.
Figure 6:
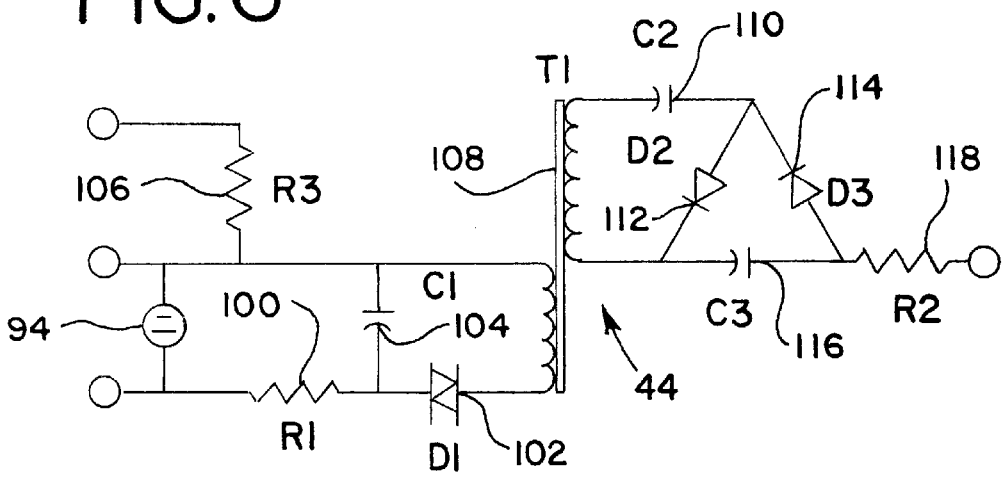
FIG. 6 is an electric drive circuit for the ionizer.

The modules preferably comprise self-cleaning ionizers 40 (FIG. 4). In the preferred embodiment, the ionizers are spaced apart from each other and are electrically connected in parallel to each other. The ionizers can also be positioned in a different arrangement or assembly than that shown in FIG. 4 or connected at least partially in series. Each of the ionizers can have a circular set, series, or array of ion-emitting needles 42, such as eight ion-emitting needles, which are energized by an electric drive circuit 44 (FIG. 6). If desired, the ion-emitting needles can be recessed so that their tips do not extend outwardly of the surface comprising a mounting plate.

An air blower system 50 (FIGS. 1 and 2) comprises electrically powered fans 52, such as 8–10 fans, which are positioned in the outlet ports at an elevation below the modules and the inlet ports. The fans cooperate with each other to draw influent air 54 into the room through the inlet ports and to the modules. Desirably, the fans also circulate the ions and air in the room, as well as blow and exhaust the purified effluent air 56 out of the room through the outlet ports. Advantageously, the fans cooperate with the modules, the inlet ports, and the outlet ports to decrease the concentration of dust and noxious gases in the room of the poultry house or swine house (hog confinement), as well as to help purify the air in the room of the poultry house or swine house. Desirably, the air purification system and process provide for cleaner emissions discharged from the poultry house or swine house and less pollution. The special air purification system is particularly helpful to purify and dedust the air and decrease ammonia and methane in the poultry house or swine house in order to improve the health, comfort, and well being of poultry, farmers, and workers.

Figure 5:
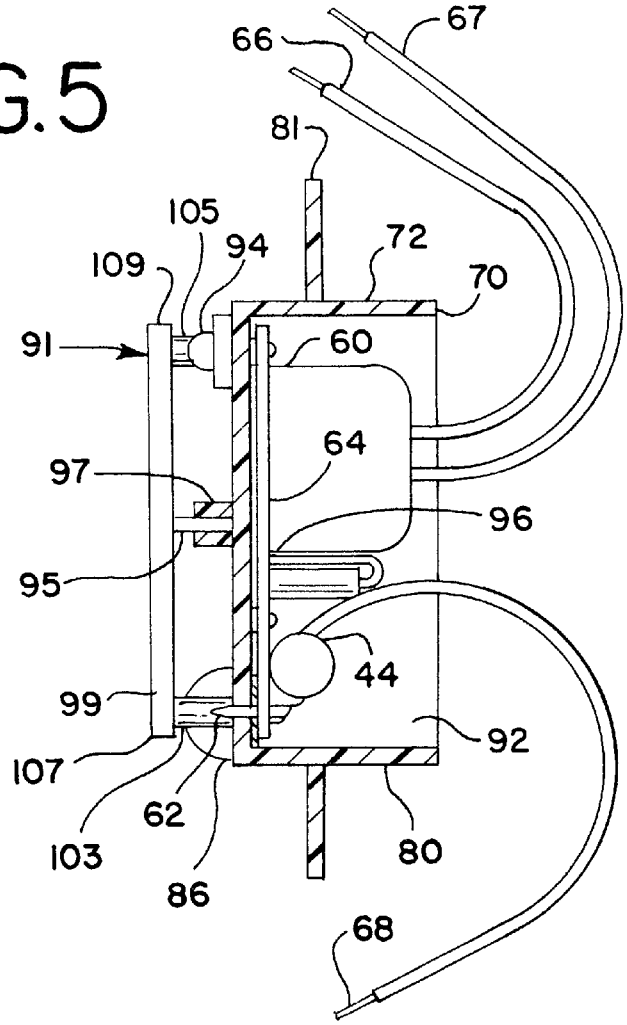
FIG. 5 is a cross-sectional view of part of the ionizer.

The ionizer can have an ion-emitting assembly 60 (FIGS. 5 and 7), also referred to as an ion-emission assembly, which emits negatively charged ions to ionize air, ammonia, methane, and airborne particulate dust and other pollutants in the room of the poultry house. The ion-emitting assembly can comprise a set, series, and array of ion emitters 62 comprising ion-emitting metal ionizing needles. The needles can be gold or nickel plated and/or made of stainless steel. The ion-emitting needles are secured to and supported by, as well as cantilevered from a circuit board 64 (FIG. 5). The needles can be electrically connected to the electric drive circuit 44 mounted on the circuit board. The electric drive circuit cyclically applies a negative potential charge to the needles at a sufficiently high voltage to ionize the air, ammonia, methane, dust, and other airborne pollutants without substantially generating ozone. Electrical wires 66–69 (FIGS. 5 and 8) can extend from the electrical circuit and circuit board to parallel electric wiring in the ceiling, wall, or roof.

Figure 7:
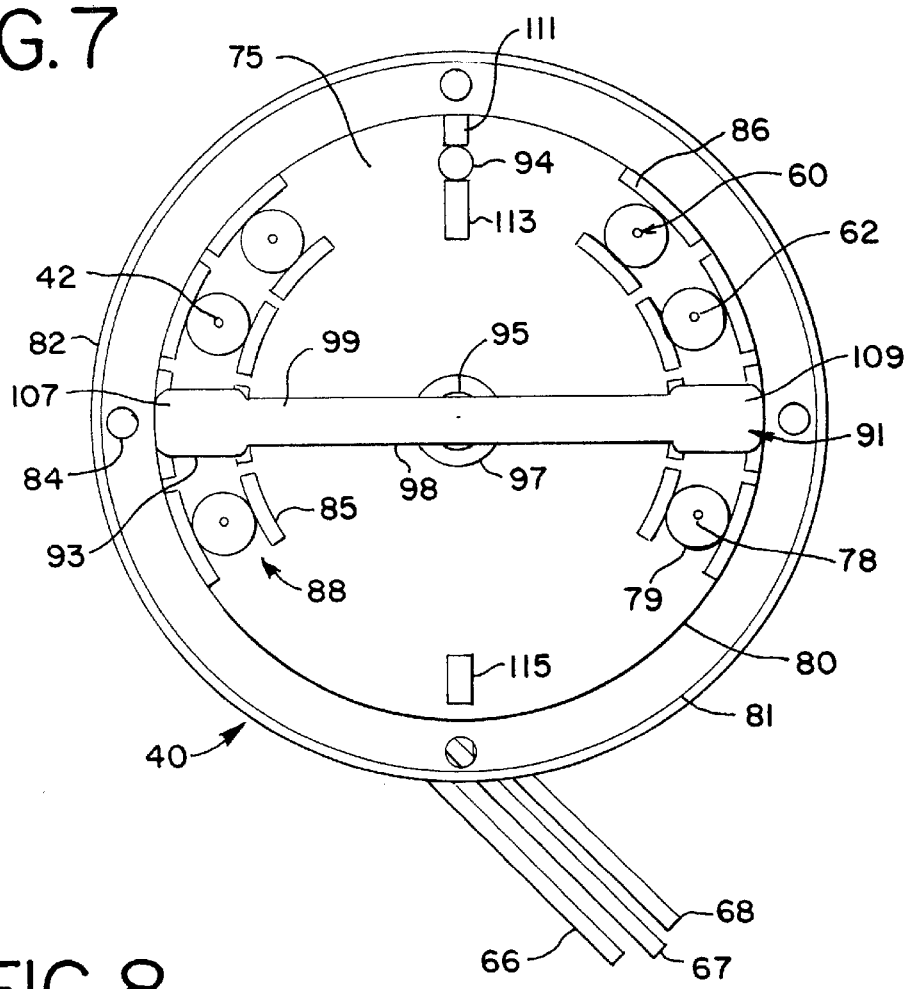
FIG. 7 is a top view of the ionizer.
Figure 8:
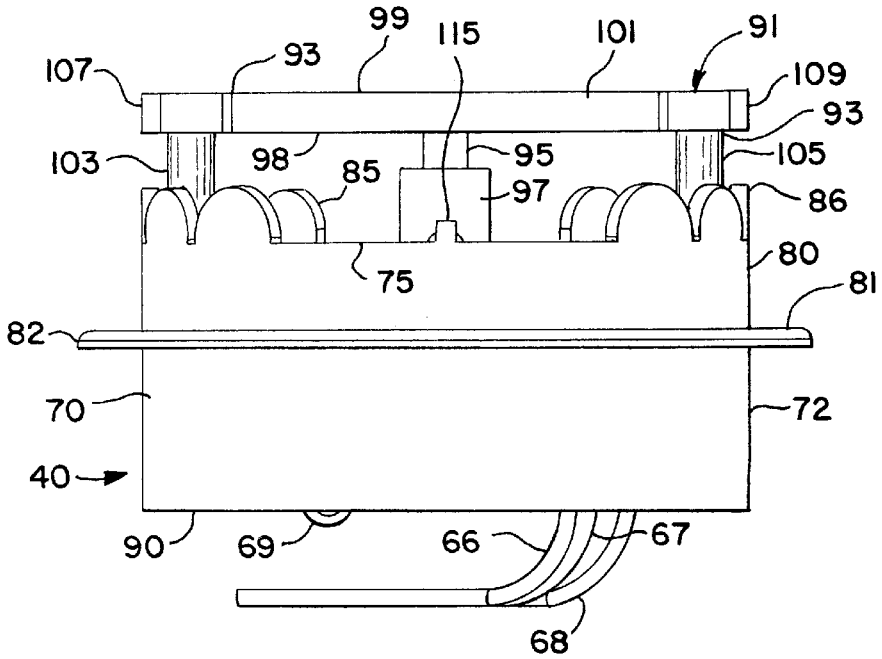
FIG. 8 is a back view of the ionizer.

The ionizer can have a circular or rounded housing assembly 70 (FIG. 4) with a circular or rounded protective housing 72 which houses, conceals, and at least partially encloses and supports the ion emission assembly. The housing can be made of an impact-resistant insulating plastic, such as acrylonitrile butadiene styrene (ABS) or other materials. The housing assembly can have a circular generally planar or flat cover 75 (FIGS. 4, 7 and 8). The cover can have an arcuate set, series or array of aligned ion-emitting apertures 78 in raised concave circular needle protectors 79 which provide needle-receiving holes about the tips of the ion-emitting needles. The housing has circular upright sides 80 which provides a circular skirt. The sides extend perpendicularly from the cover and peripherally surround the ion-emitting assembly. A peripheral annular flange 81 can extend radially outwardly from the sides at a position spaced from the cover. The peripheral flange can have a beveled, tapered or rounded circular edge 82. Screws or other fasteners can be inserted into screw holes 84 in the peripheral annular flange to securely mount the flange and housing assembly to a plastic outlet junction box and/or the ceiling, a beam, or a portion of a wall in proximity to the ceiling. The junction box can also be suspended slightly below the ceiling to avoid interfering with any pre-existing pipes or other overhanging utility apparatus in the poultry house.

In order to prevent puncturing and injuring the poultry and other animals, as well as farmers and workers, the ionizer can have a needle guard 85 (FIGS. 4, 7 and 8) comprising a series, sets and arrays of curved arcuate semicircular ribs 86 which extend outwardly from the exterior surface of the cover of the ionizer. The space between the ribs can provide air channels 88 to channel and direct the flow of air past the needles and away from the ionizer. The ribs of the needle guard substantially prevent the needles from puncturing and injuring people, poultry, swine, and other animals.

The ionizer can have a moisture resistant barrier 90 (FIGS. 4 and 8) comprising a seal, gasket or closed cell silicon rubber, which can be positioned between the needles and the mounting plate, in order to minimize water and moisture from contacting the electric circuit. The ionizer can also be filled to its sides in its interior with an electrical grade potting compound.

The self-cleaning ionizers have an ion-emitting needle cleaner 91 (FIGS. 4, 7 and 8) which is operatively connected to the ion-emitting needles to clean and remove accumulation, caking, and any build up of particulates of dust and noxious gases from the tips of the ion-emitting needles. The ion-emitting needle cleaner preferably comprises an ion-emitting needle cleaning mechanism 93 which periodically removes particulates of dust and noxious gases, such as ammonia and methane, from the tips of the ion-emitting needles. A motor-driven shaft 95 is connected to the electric circuit via a motor 96 (FIG. 5) to rotate, drive and automatically activate the ion-emitting needle cleaning mechanism. The shaft is positioned and rotates in an annular hub 97 or bearing which can extend outwardly from the cover. The ion-emitting needle cleaning mechanism includes a wiper arm assembly 98 which is driven by the motor. The wiper arm assembly includes at least one motor-driven rotatable radial arm 99 and preferably, a rotatable diametric wiper arm 101 comprising diametrically opposed integrally connected radial arm portions which can be integrally connected and extend from the shaft. The shaft and motor rotate and pivot the wiper arm. Bristles 103 and 105 extend from the diametrically opposed, enlarged outer end portions 107 and 109 of the rotatable wiper arm to brush and wipe the tips of the ion-emitting needles. The bristles preferably comprise brushes, natural or artificial hairs, fibers, flexible strips, or plastic fingers. The bristles can be cleaned by one or more stationary brush-wiping blocks 111, 113 and 115 (FIGS. 4 and 7) which can comprise diametrically aligned protuberances that extend upwardly from and are connected to the cover at a location spaced between and away from the ion-emitting needles.

A protective perforated cover can be used to provide a guard to protectively cover the wiper arm assembly and the ion-emitting needles to substantially prevent humans, poultry, and animals from touching or otherwise contacting and interfering with the wiper arm assembly, the needle cleaning mechanism and ion-emitting needles. The protective cover can comprise a flexible plastic screen with ion-emitting apertures to permit outflow (egress) of ions from the tips of the ion-emitting needles out of the self-cleaning ionizers.

The ionizer can have a visible red indicator light 94 (FIGS. 4–6) connected to the electric circuit. The indicator light can be positioned between one or more stationary brush-wiping blocks 111 and 113 (FIG. 4). As shown in FIG. 6, the electric drive circuit 44 of the ionizer can have a resistor R1 100 which is connected in series to a diode D1 102 and a capacitor C1 104. The resistor R1 100 can be connected in parallel to a resistor R3 106. A transformer T1 108 can be connected in series to diode D1 102 and a capacitor C2 110. The capacitor C2 110 can be connected in series to a diode D2 112, a diode D3 114, a capacitor C3 116, and a resistor R2 118.

The electric drive circuit can include a timing circuit comprising timing circuitry to intermittently activate and rotate the wiper arm assembly of the ion-emitting needle cleaning mechanism so that the rotatable arm of the wiper arm assembly will intermittently rotate and brush and clean the tips of the ion-emitting needles so as to periodically and automatically remove any accumulation, build up, or caking of particulates of dust and noxious gases from the tips of the needles. The rotatable arm of the wiper arm assembly can rotate in an opposite direction every other cycle to attain better cleaning of the ion emitting needles and less wear of the bristles. The rotatable arm of the wiper arm assembly can also clean and remove any accumulation, build up or caking of dust and noxious gases on the indicator light. Preferably the timing circuit comprises a RC circuit comprising a resistor R3 120 connected in parallel to a capacitor C4 122. The resistor R3 120 is connected in series to the diode. The capacitor C4 122 is connected in series to the transformer.

Advantageously, the air purification system and process enhance air circulation in a biohazardous environment, such as a poultry house, for distribution of negative ions. The modules charge most, if not all, of the airborne particulates, such as noxious gases, dust, soot, and any smoke from the heaters in the poultry house or swine house (hog confinement), with negative ions. The negatively charged particulates are then attracted to any surface with an opposite polarity, namely, a positive charge or ground, such as the floor, walls, or a collection receptacle. The attraction and collection of the charged particulates helps clean and purify the air in the room.

In the preferred embodiment, air is drawn into the room through intake ports that allow the air to circulate in a rotational movement. The exhaust fans pull the circulating air through the biohazardous area in the room and through the outlet ports where it is discharged into the atmosphere.

Advantageously, the special air purification system and process circulate and distribute a voluminous amount of negative ions throughout the entire area of the room of the poultry house or swine house (hog confinement). These ions are able to charge the particulates and greatly reduce or eliminate the harmful gases and dust from the air inside the biohazardous area of the poultry house. This in turn greatly reduces and substantially eliminates the harmful gases and dust that exit into the environment outside the biohazardous area of the poultry house or swine house (hog confinement).

As discussed above, in the air purification system and process, influent air is drawn into a room of the poultry house through air inlet passageways which define intake ports in at least one of the walls of the room of the poultry house or swine house (hog confinement). Desirably, overlapping flow patterns of ions are emitted to negatively charge particulates of dust and noxious gases, such as ammonia and methane, in the air of the room of the poultry house or swine house with an array of interconnected modules comprising ionizers. Preferably, the modules are positioned in proximity to the ceiling of the room of the poultry house at an elevation above the air inlet passageways. For best results, the ionizers are connected and maintained in parallel electrical relationship with each other. Most preferably, the modules are spaced apart and arranged in a matrix to provide a criss-cross grid pattern as viewed from the ceiling. Desirably, the modules are arranged and operated to saturate the room of the poultry house or swine house with the overlapping flow patterns of ions so that almost, if not, all of the particulates of dust and noxious gases in the air in the room of the poultry house or swine house are ionized.

Air in the room of the poultry house or swine house (hog confinement) can be heated by the butane heaters or other heaters to warm the poultry or swine. The ions and heated air in the room of the poultry house or swine house are circulated with fans positioned in the outlet ports in at least one of the walls of the poultry house or swine house. Preferably, the fans are located at an elevation below the modules and the inlet ports. The circulation helps mix the ions and air so that the ions impact and engage the dusty particulates and gases in the room of the poultry house.

The negatively charged ionized particulates of dust and noxious gases are attracted and collected on one or more surfaces having an opposite polarity charge, i.e. a positive charge or ground, such as the floor, walls, or a collection receptacle.

Purified effluent air is blown through the outlet ports and out of the room to exit the poultry house or swine house (hog confinement) so as to be discharged into the atmosphere. Advantageously, the air purification system and process decrease the concentration of dust and noxious gases in the poultry house or swine house and helps purify the air to provide a safer and healthier environment for poultry, swine, livestock, farmers and workers.

EXAMPLES 1–34

Comparison tests were conducted in two similar poultry houses. Each of the poultry houses were 40 ft.×375 ft. and contained approximately 20,000 chickens. Poultry house No. 1 was equipped with an air purification system and process generally as described in the specification and illustrated in the drawings of this patent application but without the ion-emitting needle-cleaning mechanisms. Poultry house No. 2 was similar to poultry house No. 1, except that it was not equipped with the modules of the air purification system and process. The comparison tests were conducted over a six week period.

The particulates of dust were detected using a dust analyzing instrument comprising a Denver Instrument A-160 Scale available from Denver Instrument Company, Ltd. of England which detected the dust in parts per million (ppm). A gas detection instrument comprising an ammonia diffusion tube available from Drager Australia Pty, Ltd. of Australia was provided to detect concentrations of ammonia in parts per million (ppm).

Two rows of modules were secured to the ceiling of poultry house No. 1. The first row of modules were spaced 10 ft from one of the 375 foot longitudinal walls of poultry house No. 1. The second row of modules were spaced 20 ft. from the first row of modules of poultry house No. 1. The second row of modules were also spaced 10 ft. from the other 375 foot longitudinal wall of poultry house No. 1. The inlet of each of the rows of the modules were spaced 2 ft. from the 40 ft. inlet end wall of poultry house No. 1. The outlet ends of each of the rows of modules were spaced 8 ft. from the 40 ft. outlet wall of poultry house No. 1. The first and second row of modules each had 13 ionizers which were spaced at equal intervals of 30 ft. from center to center of the ionizers. The ionizers of the first and second rows were aligned in registration with each other.

Each of the poultry houses had 30 air inlet ports (intakes). There were 15 air inlet ports (intakes) on each of the 375 foot longitudinal walls. The air inlet ports on each of the longitudinal walls were in general horizontal (longitudinal) alignment with each other. The air inlet ports were spaced longitudinally apart at equal intervals and located 8–10 feet above the floor.

Each of the poultry houses also had ten outlet ports. Six of the outlet ports were located on the exit (outlet end) wall at an elevation below the air inlet ports. Four of the outlet ports were located on the 375 ft. longitudinal walls so that there was one outlet port on each of the 375 ft. longitudinal walls in proximity to the outlet wall. Each of the outlet ports contained an exhaust fan with 4 ft blades.

TABLE 1

REMOVAL OF DUST AND AMMONIA

| Ex. No. | Dust Concentrations ppm Poultry House No. 1 | Dust Concentrations ppm Poultry House No. 2 | Ammonia Concentrations ppm Poultry House No. 1 | Ammonia Concentrations ppm Poultry House No. 2 |
|---|---|---|---|---|
| 1 | 4.06 | 2.08 | 58.8 | 72.3 |
| 2 | 2.76 | 2.83 | 33.3 | 33.3 |
| 3 | 6.58 | 7.54 | 37.5 | 125 |
| 4 | 2.18 | 5.2 | 22.2 | 22.2 |
| 5 | 1.21 | 9.75 | 35.7 | 85.7 |
| 6 | 7.48 | 7.29 | 40 | 70 |
| 7 | 3.39 | 14.65 | 16.7 | 40 |
| 8 | 1.67 | 17.08 | 13.8 | 50 |
| 9 | 0.899 | 8.39 | 25 | 43.8 |
| 10 | 4.46 | 10.85 | 16.7 | 44.4 |
| 11 | 6.15 | 1.77 | 25 | 43.8 |
| 12 | — | — | 33.3 | 100 |
| 13 | — | — | 37.5 | 62.5 |
| 14 | 12.8 | 13.4 | 25 | 75 |
| 15 | 8.96 | 10.3 | 75 | 137.5 |
| 16 | 9.89 | 8.48 | 44.4 | 55.56 |
| 17 | 4.24 | 6.9 | 37.5 | 62.5 |
| 18 | 4.87 | 5.18 | 25 | 37.5 |
| 19 | 5.26 | 5.44 | 12.5 | 12.5 |
| 20 | 4.08 | 23.6 | 22.2 | 33.3 |
| 21 | 9.28 | 13.1 | 62.5 | 100 |
| 22 | 9.63 | 14.45 | 50 | 87.5 |
| 23 | 9.31 | 43.3 | 62.5 | 75 |
| 24 | 1.99 | 1.25 | 34.4 | 37.5 |
| 25 | 2.60 | 7.35 | 6.25 | 37.5 |
| 26 | 4.70 | 7.71 | 18.18 | 27.27 |
| 27 | 6.74 | 11.6 | 37.5 | 56.25 |
| 28 | 6.80 | 11.9 | 37.5 | 43.75 |
| 29 | — | — | 62.5 | 125 |
| 30 | 5.81 | 6.14 | 56.25 | 81.25 |
| 31 | 1.588 | 2.197 | 75.0 | 78.13 |
| 32 | 7.88 | 1.62 | 37.5 | 90.63 |
| 33 | 3.35 | 3.35 | 15.63 | 15.63 |
| 34 | — | 7.87 | 25.0 | 50.0 |

The preceding tests indicated that poultry house No. 1 equipped with the air purification system and process of the invention without the ion-emitting needle cleaning mechanisms, resulted in an average of 39.5% decrease in dust and an average of 42.4% decrease in ammonia over the reference system of poultry house No. 2 which was not equipped with the modules of the air purification system and process. Observations during the tests indicated that the exhaust fans in poultry house No. 1, which used the air purification system and process of the invention, used less energy and were operating less than the exhaust fans of poultry house No. 2. Observations of the tests also indicated an increase in the growth rate of the chickens in poultry house No. 1 as well as a decrease in the death rate of chickens in poultry house No. 1 in comparison to the chickens of poultry house No. 2 which did not have the air purification system and process of the invention.

Observations of the tests also realized greater than 45% a decrease in the amount of butane needed to heat poultry house No. 1 in comparison to poultry house No. 2, because the exhaust fans which operated the ammonia gas sensors in poultry house No. 1 were able to run at a reduced speed in comparison to poultry house No. 2. This allowed the heaters in poultry house No. 1 to cycle less and use less energy than the heaters in poultry house No. 2 which did not have the air purification system and process of the invention. Observations of the tests also found that the effluent air emitted from poultry house No. 1 was much cleaner than the effluent air emitted from poultry house No. 2.

The results of the tests indicate that the air purification system and process of poultry house No. 1 resulted in: (1) cleaner air for the farmers, workers and poultry; (2) an increase in the growth rate of chickens; (3) a decrease in power to exhaust the effluent air from the poultry house; (4) a reduction in the butane needed to heat the poultry house; and (5) less pollution emitted from the poultry house to the atmosphere.

EXAMPLES 35–44

Comparison tests were conducted in two other similar poultry houses. Poultry houses Nos. 3 and 4 were similar in size, arrangement and capacity to poultry houses Nos. 1 and 2 and contained approximately 20,000 chickens. Poultry house No. 3 was equipped with an air purification system and process with self-cleaning ionizers equipped with ion-emitting needle-cleaning mechanisms as described in the specification and illustrated in the drawings of this patent application. Poultry house No. 4 was similar to poultry house No. 3, except that it was not equipped with the modules of the air purification system and process. The comparison tests were conducted over a five day period.

The particulates of dust were detected using a dust analyzing instrument comprising a Denver Instrument A-160 Scale available from Denver Instrument Company, Ltd. of England which detected the dust in parts per million (ppm) at a flow rate of 0.05618 mg/ft$^3$. A gas detection instrument comprising an ammonia diffusion tube available from Drager Australia Pty, Ltd. of Australia was provided to detect concentrations of ammonia in parts per million (ppm).

Three rows of modules of self-cleaning ionizers were secured to the ceiling of poultry house No. 3 and were arranged in a manner proportionally similar to the modules of poultry house No. 1.

Each of the poultry houses Nos. 3 and 4 had air inlet ports (intakes) and outlet ports similar to poultry houses Nos. 1 and 2. Each of the outlet ports contained an exhaust fan with blades and also had butane heaters which were functionally similar to those in poultry houses Nos. 1 and 2.

To take a representative dust sample, the following procedure was used: The equipment for taking samples of the dust and ammonia was placed in the middle of the poultry house to obtain the most accurate sampling. The tripod was set at approximately three (3) feet high and connected to the pump by the Tygon brand tubing. The cassette was placed at the end of the tubing atop the tripod with the nitrocellulose filter and filter pad closest to the tubing. The sampling pump was connected to a power outlet by the extension cord which was buried underneath the sawdust fodder to prevent the chickens from interrupting the sampling. The pump was turned on and was adjusted to have a flow of approximately fifteen (15) liters per minute (LPM) by turning the variable flow regulator knob located on the pump. The flow was confirmed by the flow meter being inserted in the end of the cassette while the pump was turned on. The time and date that the cassette was inserted, the sample number, and the initial flow rate were recorded in the data log under the appropriate poultry house location. The pump was allowed to run for approximately eight (8) hours with the cassette in place. After this time period, the cassette was removed and labeled. The final time, date, and flow rate were recorded in the data log. The sample cassette was placed in a Ziploc brand transparent plastic bag with the house number and date. The final weight of the nitrocellulose filter was determined by weighing it on an analytical balance and comparing the final weight to the initial weight.

To take a representative ammonia sample, the following procedure was followed: The diffusion tube was placed within ten (10) feet of the dust sampling apparatus but not where the air flow from the dust sampler would interfere with the ammonia reading. The tube holder and tube were placed at approximately three (3) feet above the ground. To prepare the tube for testing, the tube was broken at the breaking bead by placing the tube in the holder and following the tube manufacturer's instructions. Beginning date and time were recorded along with the appropriate sample number and house number. After a period of approximately eight (8) hours, the tube results along with the final time and date were recorded under the appropriate sample number and house number in the data log.

TABLE 2

REMOVAL OF DUST

| Example No. | Dust Concentrations ppm Poultry House No. 3 | Dust Concentrations ppm Poultry House No. 4 |
|---|---|---|
| 35 | 17.84 | 20.84 |
| 36 | 29.87 | 62.11 |
| 37 | 24.92 | 62.64 |
| 38 | 21.29 | 44.86 |
| 39 | 22.47 | 51.87 |

TABLE 3

REMOVAL OF AMMONIA

| Example No. | Ammonia Concentrations ppm Poultry House No. 3 | Ammonia Concentrations ppm Poultry House No. 4 |
|---|---|---|
| 40 | 37.5 | 37.5 |
| 41 | 43.75 | 56.25 |
| 42 | 37.5 | 50.0 |
| 43 | 24.37 | 36.87 |
| 44 | 6.25 | 24.37 |

The preceding tests indicated that poultry house No. 3 equipped with the air purification system and process with self-cleaning ionizers of the invention resulted in an average of 52% decrease in dust and an average of 27% decrease in ammonia over the reference system of poultry house No. 3 which was not equipped with the modules of the air purification system and process. Furthermore, the self-cleaning ionizers equipped with ion-emitting needle cleaning mechanisms of the inventive air purification system and process removed an average of 12.5% more dust than ionizers without the ion-emitting needle-cleaning mechanisms of the invention.

Observations during the tests indicated that the exhaust fans in poultry house No. 3, which used the air purification system and process of the invention, used less energy and were operating less than the exhaust fans of poultry house No. 4. Observations of the tests also indicated an increase in the growth rate of the chickens in poultry house No. 3 as well as a decrease in the death rate of chickens in poultry house No. 4 in comparison to the chickens of poultry house No. 2 which did not have the air purification system and process of the invention. Observations of the tests also realized greater than 45% a decrease in the amount of butane needed to heat poultry house No. 3 in comparison to poultry house No. 4, because the exhaust fans which operated the ammonia gas sensors in poultry house No. 3 were able to run at a reduced speed in comparison to poultry house No. 4. This allowed the heaters in poultry house No. 3 to cycle less and use less energy than the heaters in poultry house No. 4 which did not have the air purification system and process of the invention. Observations of the tests also found that the effluent air emitted from poultry house No. 3 was much cleaner than the effluent air emitted from poultry house No. 4.

The results of the tests indicate that the air purification system and process of poultry house No. 3 resulted in: (1) much cleaner air for the farmers, workers and poultry; (2) an increase in the growth rate of chickens; (3) a decrease in power to exhaust the effluent air from the poultry house; (4) a reduction in the butane needed to heat the poultry house; and (5) much less pollution emitted from the poultry house to the atmosphere.

Among the many advantages of the air purification system and process of this invention are:

1. Outstanding performance.
2. Superior removal of dust.
3. Superb removal of noxious gases.
4. Excellent air purification.
5. Impressive decrease of ammonia and methane.
6. Enhanced removal of particulates.
7. A healthier environment for people, plants, poultry and other animals.
8. Greater removal of pollutants and contaminants.
9. Better energy savings.
10. Increase of growth rate of poultry and swine.
11. Decrease in poultry deaths.
12. Less poultry diseases.
13. Better poultry weight and size.
14. Enhanced firmness, texture, and flavor of poultry.
15. Beneficial to the environment.
16. Better compliance with governmental environmental regulations.
17. Decrease of dirt and dust.
18. Cleaner growing and working areas.
19. Excellent ammonia reduction.
20. Simple to install.
21. Easy to use.

22. Attractive.
23. Economical.
24. Reliable.
25. User-friendly.
26. Convenient.
27. Safe.
28. Efficient.
29. Effective.

Although embodiments of the invention have been shown and described, it is to be understood that various modifications and substitutions, as well as rearrangements of parts, components, equipment, and process steps, can be made by these skilled in the art, without departing from the novel spirit and scope of this invention.

What is claimed is:

1. An air purification system, comprising:

a set of modules arranged for emitting overlapping flow patterns of ions;

each of said modules comprising a self-cleaning ionizer, said self-cleaning ionizers each comprising ion-emitting needles having tips for emitting only negatively charged ions to ionize airborne particulates of dust and noxious gases;

curved ribs providing a needle guard operatively associated with said ion-emitting needles for substantially preventing the tips of said ion-emitting needles from puncturing a human finger, poultry or animals;

a circuit for cyclically applying a negative potential charge to said ion-emitting needles;

at least one radial arm having a needle-engaging cleaner extending therefrom for engaging and cleaning the tips of said ion-emitting needles; and a motor connected to said circuit and said radial arm for intermittently rotating said radial arm so that said needle-engaging cleaner engages and periodically cleans the tips of said ion-emitting needles.

2. An air purification system in accordance with claim 1 including;

at least one fan spaced from said modules for circulating said ions;

at least one intake port spaced from said modules for ingress of air;

at least one outlet port spaced from said modules for egress of effluent air; and at least one heater spaced from said modules.

3. An air purification system in accordance with claim 1 wherein said circuit comprises timing circuitry connected to said motor for intermittently activating said radial arm to intermittently rotate said radial arm and periodically remove build up of particulates of dust from the tips of said ion-emitting needles.

4. An air purification system in accordance with claim 1 wherein said radial arm comprises a reversible rotatable radial arm assembly which rotates in opposite directions during different cycles.

5. An air purification system in accordance with claim 1 wherein said self-cleaning ionizer includes an indicator light and said radial arm further removes particulates of dust from said indicator light.

6. An air purification system in accordance with claim 1 wherein said radial arm comprises a rotatable diametric wiper arm comprising diametrically opposed integrally connected radial arm portions.

7. An air purification system in accordance with claim 1 wherein said needle-engaging cleaner includes bristles extending from said rotatable arm to brush the tips of said ion-emitting needles.

8. An air purification system in accordance with claim 7 wherein said bristles are selected from the group consisting of: brushes, natural hairs, artificial hairs, fibers, flexible strips, and plastic fingers.

9. An air purification system in accordance with claim 7 wherein said self-cleaning ionnizer includes a cover and wiping blocks comprising protuberances extending from and connected to said cover for cleaning said bristles.

10. An air purification system in accordance with claim 9 wherein:

said curved ribs comprise semicircular ribs; and said cover is substantially circular.

11. An air purification system for use in a poultry house, hog confinement, paper mill, industrial facility, factory, or dwelling, comprising:

a room having upright walls and a ceiling;

an aliquot series of air inlet passageways defining intake ports in at least one of said walls or ceiling for ingress of air into the room;

an array of interconnected modules in proximity to the ceiling and positioned at an elevation above said air inlet passageways, said modules cooperating with each other for emitting overlapping flow patterns of ions to charge particulates of dust and noxious gases in the air of said room, said modules comprising ionizers, said ionizers being spaced apart from each other, and each of said ionizers having a set of ion-emitting needles energized by an electric circuit;

an aliquot series of air outlet passageways defining outlet ports in at least one of said wall for egress of effluent air from said room, said outlet ports being substantially larger than said inlet ports and being spaced at an elevation below said inlet ports;

an air blower system comprising electrically powered fans positioned in said outlet ports at an elevation below said modules and said inlet ports, said fans cooperating with each other to draw influent air into the room through said inlet ports to circulate the ions and air in the room and to blow effluent air out of the room through said outlet ports;

said inlet ports being spaced at an elevation between said modules and said outlet ports;

said fans cooperating with said modules, said inlet ports, and said outlet ports for decreasing the concentration of dust and noxious gases in the room to help purify the air in the room;

each of said modules comprising a self-cleaning ionizer, said self cleaning ionizer comprising ion-emitting needles having tips for emitting only negatively charged ions to ionize airborne particulates of dust and noxious gases;

curved ribs providing a needle guard operatively associated with said ion-emitting needles for substantially preventing the tips of said ion-emitting needles from puncturing a human finger, poultry or animals;

a circuit for cyclically applying a negative potential charge to said ion-emitting needles;

at least one radial arm having a needle-engaging cleaner extending therefrom for engaging and cleaning the tips of said ion-emitting needles; and a motor connected to said circuit and said radial arm for intermittently rotating said radial arm so that said needle-engaging cleaner engages and periodically cleans the tips of said ion-emitting needles.

12. An air purification system in accordance with claim 11 wherein:

said noxious gases comprise ammonia and methane;

said ionizers comprise self-cleaning ionizers; and said self-cleaning ionizers are connected in parallel with each other.

13. An air purification system in accordance with claim 11 including heaters for heating the air in the room.

14. An air purification system in accordance with claim 11 wherein said modules are arranged in a matrix to provide a criss-cross grid as viewed from the ceiling for substantially saturating the room with ions.

15. An air purification process, comprising steps of:

emitting overlapping flow patterns of ions in a room with a set of modules;

ionizing airborne dust in the room with said ions;

circulating air and ions in the room with at least one fan spaced from said modules;

heating the air in the room with at least one heater spaced from said fan;

drawing influent air into the room;

discharging effluent air out of the room;

each of said modules comprising a self-cleaning ionizer, said self-cleaning ionizer comprising ion-emitting needles having tips for emitting only negatively charged ions to ionize airborne particulates of dust and noxious gases;

curved ribs providing a needle guard operatively associated with said ion-emitting needles for substantially preventing the tips of said ion-emitting needles from puncturing a human finger, poultry or animals;

a circuit for cyclically applying a negative potential charge to said ion-emitting needles;

at least one radial arm having a needle-engaging cleaner extending therefrom for engaging and cleaning the tips of said ion-emitting needles; and a motor connected to said circuit and said radial arm for intermittently rotating said radial arm so that said needle-engaging cleaner engages and periodically cleans the tips of said ion-emitting needles.

16. An air purification process for use in a poultry house, hog confinement, paper mill, industrial facility, factory, or dwelling, comprising the steps of:

drawing influent air into a room through air inlet passageways defining intake ports in at least one of the walls or ceiling of the room;

emitting overlapping flow patterns of ions to charge particulates of dust and noxious gases in the air of the room with an array of interconnected modules, said modules being positioned in proximity to the ceiling of the room and at a elevation above the air inlet passageways, said modules comprising ionizers, said ionizers being spaced apart from each other, and each of the ionizers having a set of ion-emitting needles energized by an electric circuit;

circulating the ions and air in the room with fans positioned in outlet ports in at least one of the walls of the room, the fans being located at an elevation below the modules and the inlet ports;

attracting and collecting the charged particulates of dust and noxious gases with an opposite polarity charge;

blowing effluent air through said outlet ports and out of the room;

decreasing the concentration of dust and noxious gases in the room to help purify the air in the room; and each of said modules comprising a self-cleaning ionizer, said self-cleaning ionizer comprising ion-emitting needles having tips for emitting only negatively charged ions to ionize airborne particulates of dust and noxious gases;

curved ribs providing a needle guard operatively associated with said ion-emitting needles for substantially preventing the tips of said ion-emitting needles from puncturing a human finger, poultry or animals;

a circuit for cyclically applying a negative potential charge to said ion-emitting needles;

at least one radial arm having a needle-engaging cleaner extending therefrom for engaging and cleaning the tips of said ion-emitting needles; and a motor connected to said circuit and said radial arm for intermittently rotating said radial arm so that said needle-engaging cleaner engages and periodically cleans the tips of said ion-emitting needles.

17. An air purification process in accordance with claim 16 for use in a poultry house or hog confinement for housing and growing poultry comprising chickens, turkeys, ducks, or ostriches, or for growing swine comprising hogs or pigs, said noxious gases comprising ammonia and methane, and said process includes heating the air in the room to warm the poultry or swine.

18. An air purification process in accordance with claim 16 including:

substantially saturating the room with said overlapping flow pattern of ions; and said modules are arranged in rows viewed from the ceiling.

19. A self-cleaning ionizer, comprising:

an ion-emitting assembly comprising ion emitters for emitting negatively charged ions to ionize airborne particulates of dust and noxious gases in an area, said ion emitters comprising in an array of ion-emitting needles, said ion-emitting needles having tips, a circuit board secured to and supporting ion-emitting needles, an electric circuit mounted on said circuit board for cyclically applying a negative potential charge to said ion-emitting needles at a sufficiently high voltage to ionize the particulates and noxious gases without substantially generating ozone, and an electrical wire connected to said electrical circuit and extending from said circuit board for connection to an electrical box mounted to a ceiling or wall;

a housing assembly for at least partially enclosing and supporting said ion-emitting assembly, said housing assembly having a cover defining ion-emitting apertures about said ion-emitting needles, a skirt extending from said cover and peripherally surrounding said ion-emitting assembly, a peripheral flange extending from and about said skirt for securing said housing assembly to a surface of the electrical box, ceiling, or wall; and an ion-emitting needle cleaner assembly comprising at least one radial arm with a needle-engaging cleaner extending therefrom for engaging the tips of said ion-emitting needles to remove accumulation of particulates of dust from the tips of said ion-emitting needles;

said electrical circuit comprising timing circuitry connected to a motor for intermittently activating said radial arm to intermittently rotate said radial arm and periodically remove build up of particulates of dust from the tips of said ion-emitting needles; and including curved ribs providing a curved needle guard extending from said cover for substantially preventing the tips of said ion-emitting needles from puncturing a human finger, poultry, or animals.

* * * * *